US007644543B2

(12) United States Patent
Amidon, II et al.

(10) Patent No.: US 7,644,543 B2
(45) Date of Patent: Jan. 12, 2010

(54) SECLUSION ROOM WITH MOVABLE WALL

(75) Inventors: Joel P. Amidon, II, 1317 N. Madison St., Rome, NY (US) 13440; Tammy Conley, 67 Henderson St., New York Mills, NY (US) 13417

(73) Assignees: Joel P. Amidon, II, Rome, NY (US); Tammy Conley, New York Mills, NY (US)

( * ) Notice: Subject to any disclaimer, the term of this patent is extended or adjusted under 35 U.S.C. 154(b) by 0 days.

(21) Appl. No.: 12/112,089

(22) Filed: Apr. 30, 2008

(65) Prior Publication Data

US 2009/0272048 A1 Nov. 5, 2009

(51) Int. Cl.
*E04B 1/346* (2006.01)
*E04B 7/16* (2006.01)
*E04H 3/08* (2006.01)

(52) U.S. Cl. ..... 52/64; 52/106

(58) Field of Classification Search ..... 52/243.1, 52/64, 67, 70, 71, 72, 29, 106; 119/473, 119/472; 109/64, 1 R
See application file for complete search history.

(56) References Cited

U.S. PATENT DOCUMENTS

| | | | | | |
|---|---|---|---|---|---|
| 2,715,542 | A | * | 8/1955 | Gould | 293/341.15 |
| 3,399,654 | A | | 9/1968 | Schroer | |
| 3,760,768 | A | * | 9/1973 | Patterson | 119/473 |
| 4,294,049 | A | * | 10/1981 | Young et al. | 52/20 |
| 4,468,886 | A | * | 9/1984 | Tew | 49/141 |
| 4,571,904 | A | | 2/1986 | Kessler et al. | |
| 4,843,788 | A | | 7/1989 | Gavin et al. | |
| 4,917,419 | A | * | 4/1990 | Mora et al. | 292/144 |
| 4,929,003 | A | * | 5/1990 | McConnell | 292/144 |
| 4,991,543 | A | * | 2/1991 | Silberman | 119/473 |
| 5,056,465 | A | | 10/1991 | Eder et al. | |
| 5,255,479 | A | * | 10/1993 | Shepherd | 52/127.8 |
| 5,327,682 | A | * | 7/1994 | Holtz | 49/463 |
| 5,329,869 | A | * | 7/1994 | Freeman et al. | 114/117 |
| 5,355,626 | A | * | 10/1994 | Sachs | 49/436 |
| 5,549,068 | A | * | 8/1996 | Freeman et al. | 114/117 |
| 5,571,241 | A | | 11/1996 | Nagata | |
| 5,593,191 | A | * | 1/1997 | DeMarco | 292/144 |
| 6,016,636 | A | * | 1/2000 | Caputo | 52/745.2 |
| 6,182,402 | B1 | * | 2/2001 | Aalst | 52/106 |
| 6,540,288 | B1 | * | 4/2003 | Tobin | 296/216.02 |
| 6,971,208 | B2 | | 12/2005 | Krueger | |
| 6,981,728 | B2 | * | 1/2006 | Rasmussen | 296/26.01 |
| 7,228,664 | B2 | * | 6/2007 | Clark | 52/243.1 |
| 7,454,868 | B2 | * | 11/2008 | Clark | 52/243.1 |
| 2006/0037519 | A1 | * | 2/2006 | Dunstan | 109/74 |
| 2006/0086057 | A1 | * | 4/2006 | Rasenberger et al. | 52/202 |

* cited by examiner

*Primary Examiner*—Richard E Chilcot, Jr.
*Assistant Examiner*—James Ference
(74) *Attorney, Agent, or Firm*—Bernhard P. Molldrem, Jr.

(57) ABSTRACT

A seclusion room for patients having emotional disturbances has one moving wall positioned ahead of a fixed wall. The moving wall can be moved to an extended position to narrow the patient space leading to the main door to the room. A second door to the room enables an extraction team member enter the space between the fixed and moving wall, where the team member can remove a hatch from the moving wall and enter the space behind the patient. The team member can use the hatch as a shield to push the patient gently toward the exit door. A bench or seat disappears when the moving wall is moved to its extended position.

10 Claims, 13 Drawing Sheets

SECLUSION ROOM WITH MOVABLE WALL

BACKGROUND OF THE INVENTION

This invention relates to structures used to hold mental health patients and patients with behavioral problems where they are isolated from other patients and can be kept under observation during a behavioral episode, so that the patient can be kept from harming himself or others. The invention is specifically directed to the structure of a so-called seclusion room, which features a means for facilitating extraction of the patient from the seclusion room with minimal danger to the patient or to hospital staff.

Improved seclusion rooms have been proposed for the treatment and handling of individuals whose violent behavior may make them a threat to themselves or others. A patient unable to control his or her behavior is placed into an enclosed space or room, so the patient may be confined and isolated from other patients and from staff members until the patient's violent episode passes. In some cases, the walls, floor, and ceiling of the room may be cushioned or padded as a way of preventing the patient from injuring himself. In the typical seclusion room, there is a single door with an observation window, and an attendant or guard stands outside the room to monitor the patient during the period of confinement. When the patient becomes calm, the attendant can decide that the patient's violent episode has passed, and the decision can be made to end the confinement and allow the patient to return to the ward. Some medication may need to be administered at that time. On the other hand, if the patient's behavioral episode continues or if the patient becomes more violent, then it may be necessary for a team of staff members to enter the seclusion room and remove or extract the patient, control or calm the patient, and have appropriate medications administered to him.

A principal requirement for a seclusion room or chamber is that it must be a place where the patient can be temporarily isolated, under observation, so that a temporary behavioral flare up will not result in harm to the patient or to others. However, an important consideration which has been overlooked in the past is the safety of the attendants or guards, and particularly at those times when the violent patient has to be extracted from the seclusion room.

Normally, when an inmate or patient is placed into the seclusion room, an attendant monitors the patient by watching him or her through a viewing window in the room door. Most of the time, the patient will calm down within a few minutes, and can be removed and then administered the appropriate medications. However, in some cases the patient will become more and more violent after confinement in the seclusion room, and the monitoring attendant will decide to enter the room to keep the inmate from injuring himself or herself. At this point, the attendant is subject to violent injury, even when there is an extraction team of staff members present and trained to subdue the patient or inmate. Thus, there is a need to reconfigure the room environment to make it possible to extract the patient or inmate safely, i.e., to bring the violent patient out of the seclusion room without an increased risk of injury to either patient or staff.

OBJECTS AND SUMMARY OF THE INVENTION

Accordingly, it is an object to provide a seclusion room which addresses the above-noted problem, and overcomes the drawbacks of the prior art.

It is a more specific object to provide a seclusion room that can be configured to limit the path of movement of the patient, and to permit extraction team members to enter the room and push or urge the patient out to where other extraction team members can restrain the patient so that appropriate medications or other treatment can be administered to end the violent behavioral episode.

It is a still further object to provide a design for a seclusion room that is simple to operate and which affords maximum protection for the extraction team.

According to one aspect of this invention, the seclusion room is constructed with one movable wall which can be displaced laterally, e.g., from right to left, to change the interior dimensions of the open room space (typically eight feet by eight feet) to a narrow space (e.g., two feet by eight feet). This confines the patient's motion to this narrow corridor that leads only to the main room door.

A hatched manway or opening is included in the moving wall as a way for an extraction team member or members to enter the narrow corridor behind the patient, and to push or urge the patient towards the room door, so that the door can be opened and the patient or inmate can be pushed out into a confining blanket held by other members of the extraction team. The staff attendants or guards do not need to go into the room through the main door, and are not subject to attack by the patient or inmate; accordingly, there are significantly fewer incidents of injuries to the staff members, as well as a smaller risk of injury to the patient. In practice, this design for a seclusion room cuts down on much of the paid injury time that affects many attendants or guards, and which is a significant cost factor incurred by hospitals and psychiatric centers.

With the seclusion room construction of this invention, a patient is temporarily confined in the room. At one side of a front wall of the room there is a primary door, used for entry and exit, and the attendant observes the patient through an observation window in the primary door. There is plain, fixed side wall on the side of the room where the main door is located, and a moving wall on the opposite side. Normally, the moving wall is situated in a retracted position, substantially against a fixed side wall on that side.

There is a second door on the other side of the front wall, i.e., towards the location of the moving wall. This is used only when the moving wall has been moved out to an extended position, where the wall is more or less aligned with one edge of the principal door. Then the patient is confined in the narrow space (e.g., two feet by eight feet) between the first side wall and the moving wall. Members of the extraction team can then enter, via the second door, into the space that opens up between the second fixed wall and the moving wall.

At the rear end of the moving wall, i.e., near the back wall of the seclusion room, is a hatch or door that can be opened by the extraction team so they can enter the narrow space behind the patient. In a preferred mode, the hatch removes from the wall, and can serve as a shield to push the violent patient toward the primary door. There can be an angled wall or chamfer at the corner where the first fixed wall joins the back wall, as a means of preventing the patient getting behind the hatch-shield when the extraction team enters the confined narrow space.

There are tracks or glides at the front and back walls of the room, and cooperating hardware on the edges of the moving wall, so that the moving wall can move easily between the retracted and extended positions. These are configured so that there is insufficient space for the patient to insert a finger or other body part, to prevent patient injury. Also, a bench or seat mounted on the second, fixed wall is cantilevered so that it protrudes through a slot in the moving wall, so that the seat or bench disappears when the wall is moved towards the extended position. Thus, there is no furniture in the confined space which the patient can use as a weapon, but there is still a place for the patient to sit during the temporary confinement.

A motor driven mechanism is preferably used for moving the wall between the retracted and extended positions, which can be operated from a control panel on the exterior of the front wall, near the main door. In some embodiments, a manual crank system can be used to move the wall.

In one preferred configuration, the seclusion room is formed of a floor, a ceiling, a back wall, a first fixed side wall, a second fixed side wall, and a front wall meeting the first and second fixed side walls at respective corners, and with a first or primary door disposed in the front wall near the corner with the first wall. A second door is disposed in the front wall near the corner with the second fixed wall. A movable side wall spans from floor to ceiling and from back wall to front wall. This movable wall is normally disposed in a withdrawn position against the second fixed wall. A track mechanism has components disposed at the back wall and at the front wall, and these engage corresponding structure on edges of the movable wall. These track components extend from the second fixed wall to an position substantially at one edge of the primary door, and permit the movable wall to travel from its withdrawn position to an extended position near that edge of the primary door. In this seclusion room, the first wall and the movable wall define a narrow patient space (e.g., about two feet wide) between them when the movable wall is in its extended position.

There is a door opening or manway formed in the movable wall at the side towards the back wall, and a hatch is disposed in this manway. The hatch is latched securely to the movable wall, but is removable from the manway when the movable wall is in its extended position, i.e., when a space has opened up behind the movable wall.

The latch mechanism is actuable only from behind the movable wall, i.e., between the second wall and the movable wall to permit an extraction team member to remove the hatch to enter, through the manway, into the narrow space. This latch mechanism can take the form of a plurality of sliding pin locks, with pin members slidably mounted on movable wall outside the manway, and with the pins engaging respective pin apertures in the hatch. The hatch is removable from the manway and is adapted to be used as a shield by the extraction team member(s). The hatch can be provided with a pair of carrying handles disposed on its back side i.e., the side normally facing the second, fixed wall. The hatch can also include a visibility window formed of a transparent material.

A patient seat, which disappears when the moving wall moves to the extended position, has a bracket member affixed onto the second wall, and a seat or bench portion that is cantilevered from the bracket member so that it extends out horizontally towards the other or first wall. There is a slot for this seat portion provided in the movable wall, and the seat portion penetrates through this slot into the patient space when the movable wall is in its withdrawn position.

A drive mechanism controlled by the attendant moves the movable wall between its withdrawn position and its extended position. This mechanism includes a motor, drive members within the track mechanism components which are rotatable in unison to move the movable wall, and a rotary drive linkage mechanism that couples the motor to the drive members. This drive mechanism can employ a control panel positioned on an exterior side of the front wall, preferably between the primary door and the second door, with manually actuable switch(es) for commencing movement of the movable wall.

An angled corner wall portion joins the back wall and the first fixed side wall, and serves to block the patient from getting around behind the hatch or shield when the extraction team enters the narrow space.

In many cases, the movement of the wall towards the patient, and the collapsing of the room to a more confined space, will be enough to cause the patient to calm down and cease the violent episode. In that case, it is unnecessary for the extraction team to take any action. The attendant can move the wall back to its retracted position, and allow the patient to pass the remaining time of his or her confinement or seclusion.

The above and many other objects, features, and advantages of this invention will become apparent from the following discussion of a selected preferred embodiment, which should be read in conjunction with the accompanying Drawing.

DETAILED DESCRIPTION OF THE PREFERRED EMBODIMENT

Figure 1:
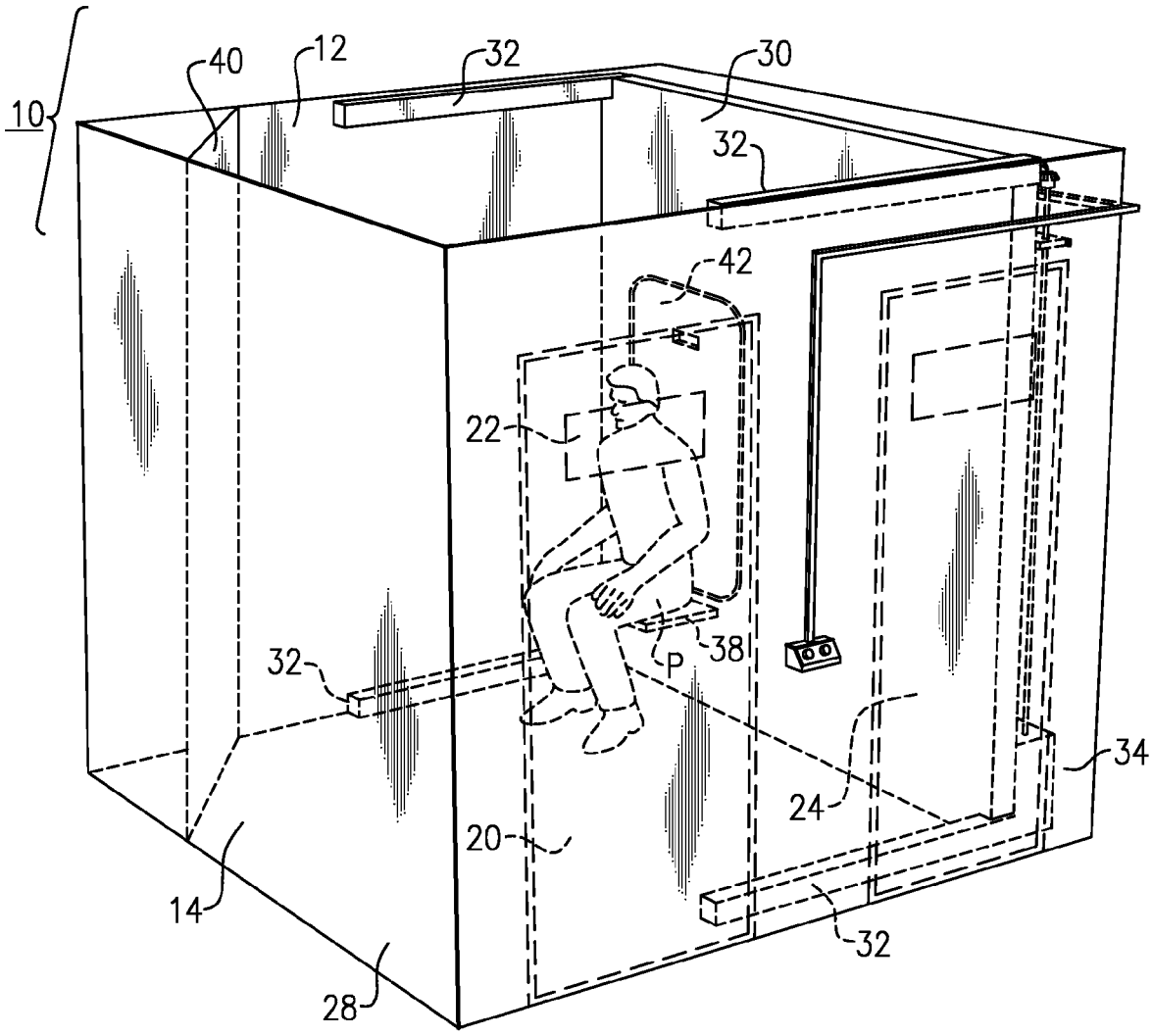
FIG. 1 is a perspective view of an embodiment of a seclusion room of this invention showing a patient seated in the room; portions of the seclusion room are shown in broken line.

With reference to the Drawing, and initially to FIG. 1, a seclusion room 10 is constructed with four solid walls, a floor and a ceiling, including a back wall 12, a left side wall 14, a right fixed side wall 16, and a front wall 18, the front wall having a principal door 20 through which the patient enters and exits the room. In normal circumstances, this is the only door that is used. There is an observation window 22 in the door to allow a guard or attendant to monitor the activity of a patient who has been temporarily confined in the room 10 for his own protection and for the protection of others. In this embodiment, the door 20 is provided at the left side of the front wall 18, near the corner with the left side wall 14. A secondary door or auxiliary door 24 is located at the right side of the room on the front wall 18. The auxiliary door is used only for patient extraction purposes when the patient becomes more violent while in the seclusion room. The floor 28 of the room is shown here, but the ceiling is omitted in this view and in other views to follow, better to show the interior features of the room.

There are recessed lighting fixtures (not shown) in the ceiling and/or one of the walls for lighting the interior of the seclusion room.

Shown at the right is a moving wall 30, which is normally positioned in a withdrawn position at the extreme right of the room, adjacent or against the fixed right wall 16. This wall can be moved to the left, under control of the attendant(s) or guard(s), as a means for controlling the patient and aiding in extraction of the patient from the seclusion room, when necessary.

In this embodiment, there are four track members 32, 32, 32, 32, each in the form of a generally square tubular member enclosing a threaded rod that engages corresponding hardware in a corner of the moving wall 30, to move the wall between its normal, withdrawn position and an extended position. In the latter position, the wall 30 can favorably be substantially aligned with one edge of the principal door 20. There is a drive mechanism 34 in the small space between the fixed wall 16 and the moving wall 30, which will be described in more detail shortly, and a control panel 36 for this is mounted on the front wall 18 of the room 10, preferably on the space between the two doors 20 and 24.

A patient P is illustrated here, seated upon a bench 38 that projects through a slot or opening in the moving wall 30. Also shown here are an angled or chamfered corner wall portion 40 at the corner of the back wall 12 and left side wall 14, and a removable hatch 42 in the moving wall 30 near the back wall 12.

Figure 2:
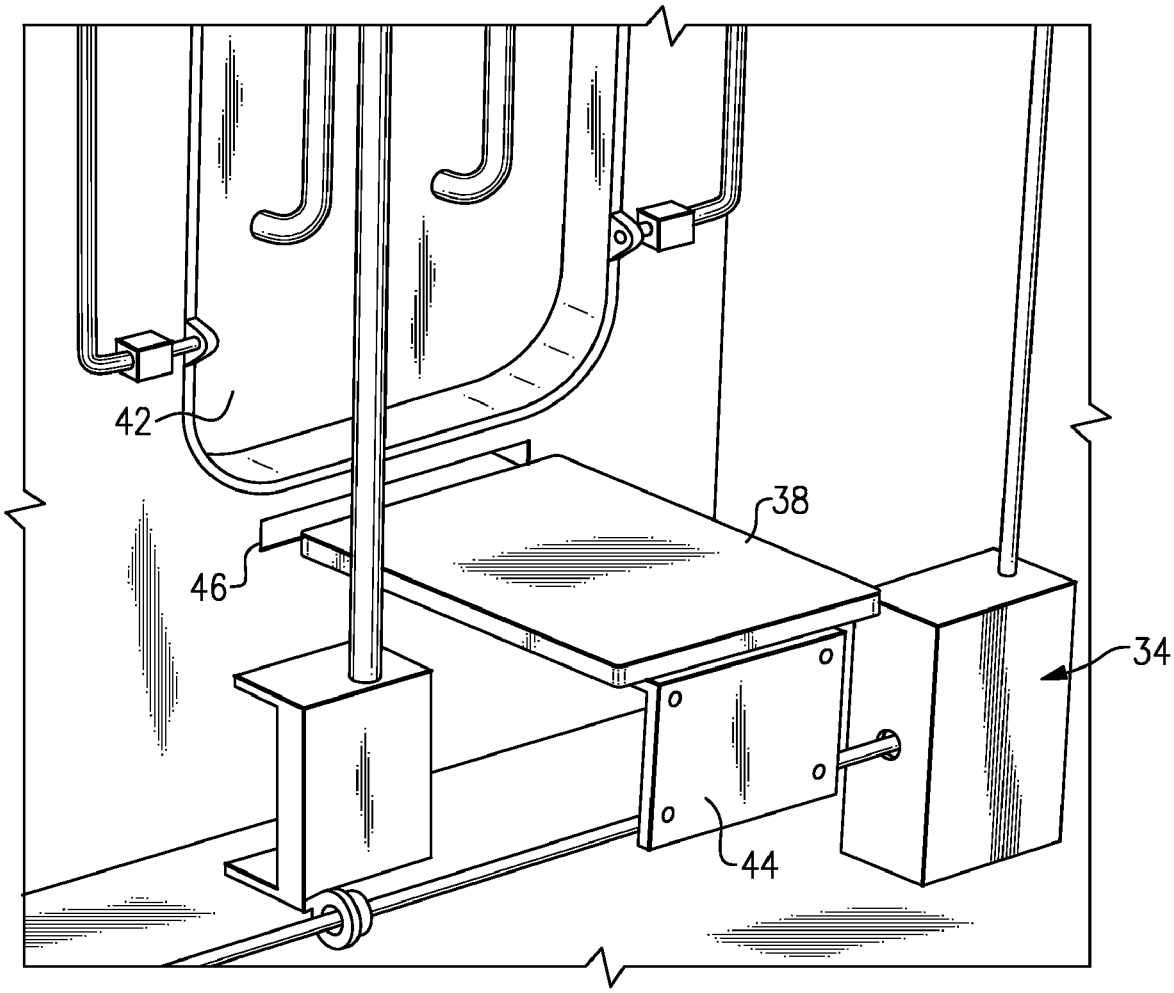
FIG. 2 is a detail perspective view of the disappearing patient seat and a portion of the removable hatch and drive mechanism of this embodiment.

As shown in more detail in FIG. 2, the seat or bench 38 includes a flat seat portion and a bracket 44 which mounts onto the fixed side wall 16 behind the moving wall 30. The bench seat portion is cantilevered from the bracket portion and projects through a slot 46 in the moving wall, here formed just below the removable hatch 42. This construction of the seat or bench provides a place for the patient P to be seated under normal circumstances, but when it is necessary to move the wall 30 to extract the patient from the room 10, the bench disappears behind the moving wall, denying the violent patient the use of furniture as a possible weapon. There is no need for a chair in this system.

A corner bench would be possible, supported on the back wall 12, with a slot in the moving wall 30 to accommodate that bench.

Figure 3:
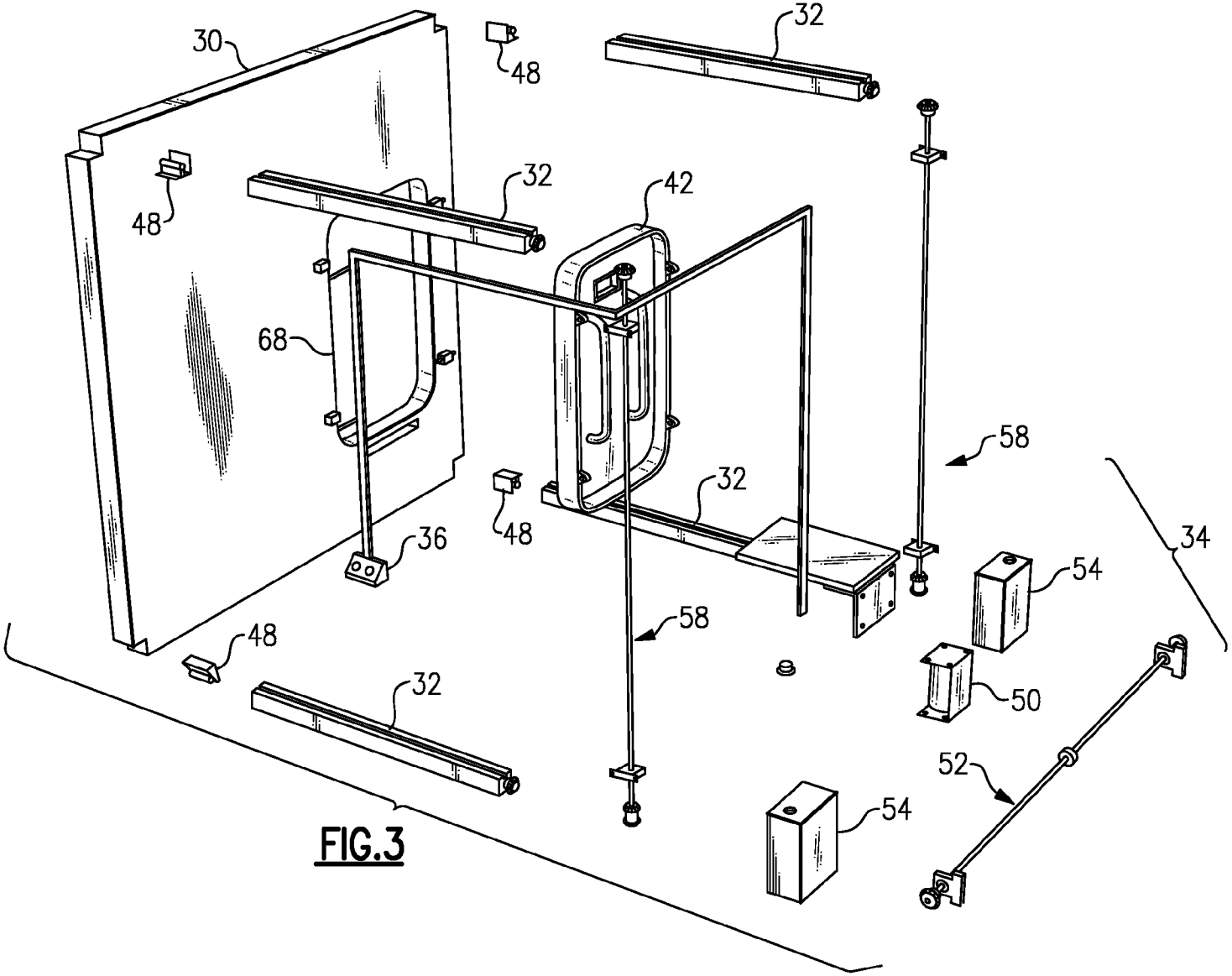
FIG. 3 is an exploded assembly view of the movable wall and drive mechanism of this embodiment.

Details of the moving wall 30 and drive mechanism 36 are shown in the exploded view of FIG. 3. Here the track members or rail assemblies 32, 32, 32, 32 are illustrated, one at each corner of the moving wall 30, and disposed at the ceiling, adjacent the front wall and back wall, and at the floor, adjacent the front wall and back wall. There is also wall hardware 48, in the form of corner brackets which have a member that projects through a slot in the corresponding rail assembly to engage the rotary threaded rod, and to move the wall 30 away from and towards the fixed wall 16. Each of the track members or rail assemblies extends laterally from the right side wall 16 to a point that is substantially even with the right edge of the principal door 20, so the travel of the wall 30 extends to that point.

Shown at the right lower part of FIG. 3 is a drive motor 50, which powers a horizontal drive member 52, including a horizontal rotary shaft with a bevel gear at each end. There are left and right gear boxes 54 housing the connections with vertical drive members 58 at the left and right, each of which is coupled to upper and lower ones of the track members 32, and each of which includes a vertical rotary shaft and upper and lower bevel gears.

Figure 4:
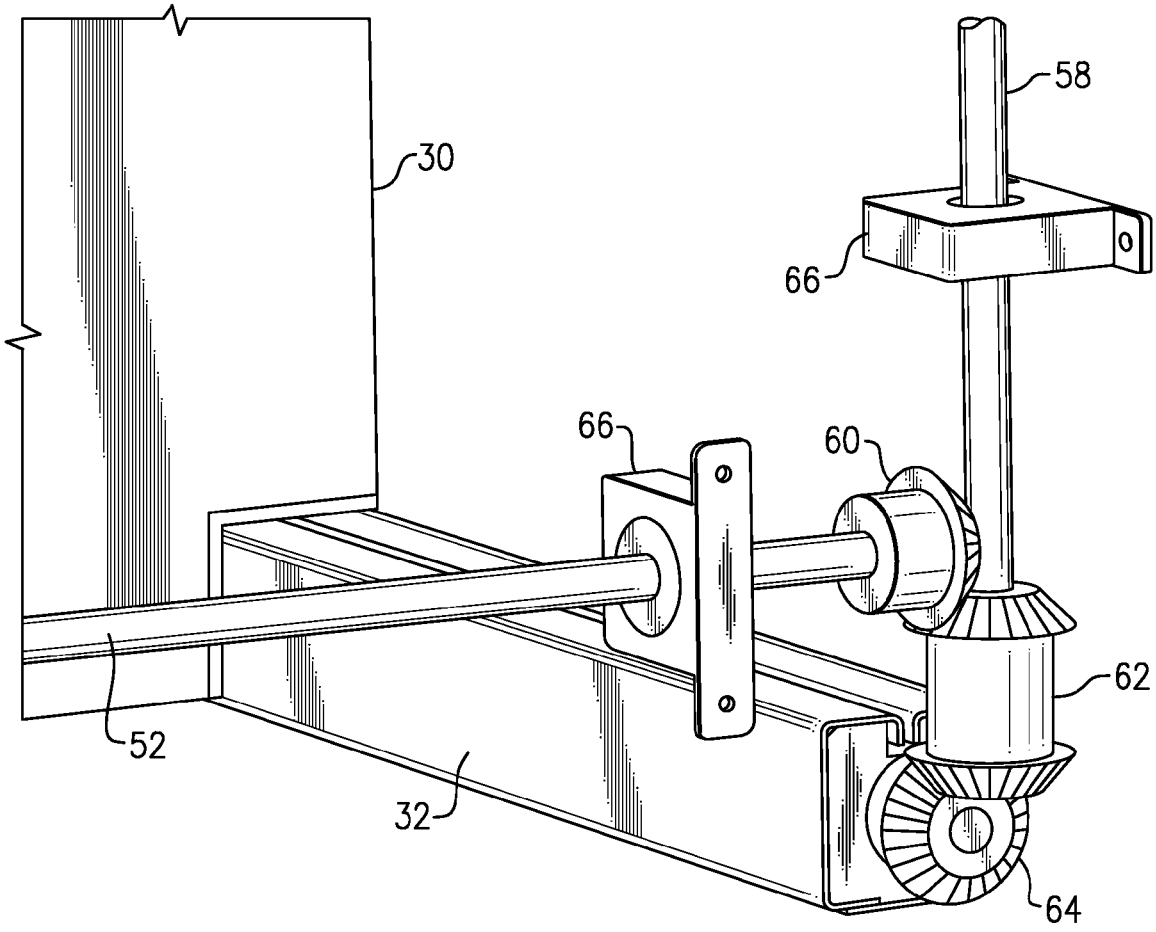
FIG. 4 is a detail view of a portion of the drive mechanism thereof.

As shown in more detail in FIG. 4, one end of the horizontal drive member 52 is shown, including a horizontal drive bevel gear 60, which meshes with one side of a twin bevel gear 62 at the lower end of one of the vertical drive members 58. The second face of this twin bevel gear 62 meshes with a bevel gear 64 that is positioned on the rotary shaft within the lower right track member 32. The lower end of the other vertical drive member and the left end of the horizontal drive member would have similar construction. The upper ends of the vertical drive members have single bevel gears that mesh with the bevel gears for the two upper track members.

Bearing blocks 64 mount the vertical and horizontal shafts onto the associated fixed walls of the room behind the moving wall 30.

Figure 6:
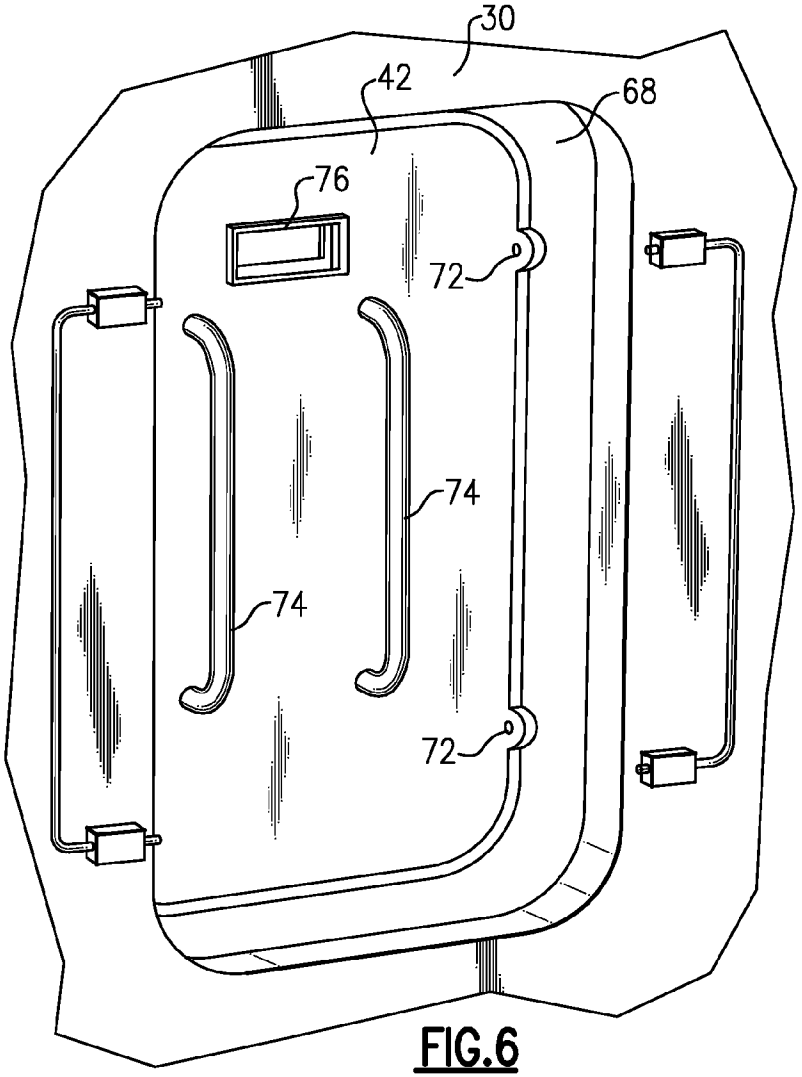
FIG. 6 is a similar perspective view of showing the hatch/shield displaced to permit entry of an extraction team into the narrowed patient space when the moving wall has moved to its extended position.
Figure 5:
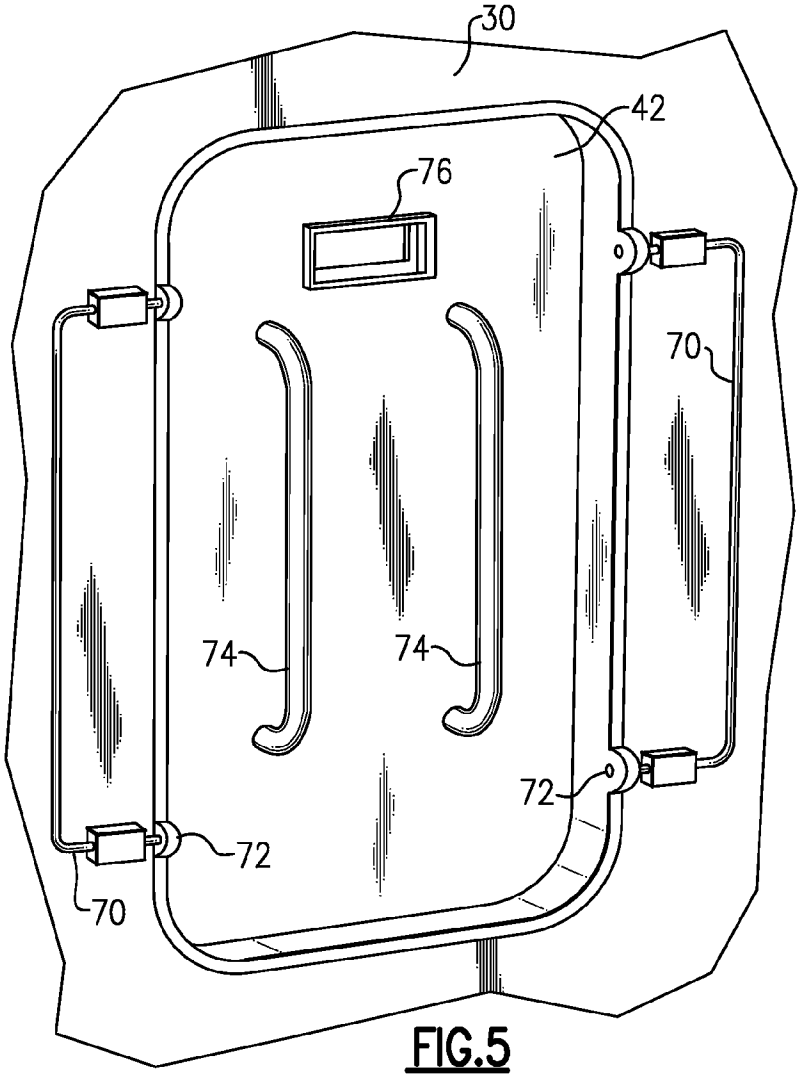
FIG. 5 is a perspective view showing the removable hatch/shield positioned in a manway formed in the movable wall.

As shown in FIG. 5 and FIG. 6, the removable hatch 42 is of generally rectangular shape with rounded corners, and is designed to be an appropriate size and weight to be used as a shield for an extraction team member having to enter the patient space. The hatch fits into a manway or opening 68 in the movable wall. Here the seat slot 46 is shown just below the manway 68, but in some embodiments the slot could be in the hatch/shield. There is a pin lock mechanism 70 on each of the right and left sides of the manway 68, each having an upper and lower retaining pin. The pins are slidably held in structure on the back side of the moving wall 30, and these pins engage pin openings 72 formed on the edges of the hatch 42. The pin locks 70 can be released only by a person behind the moving wall 30, and are not accessible by the patient P.

There are also a pair of vertical handles 74 formed on the back side of the hatch, so that the extraction team member can hold the hatch and use it as a shield to help push the patient towards the main door 20 in an extraction procedure. Also, a small observation window 76, formed of a tough transparent plastic material, is located at an upper part of the hatch 42.

In most cases, when the patient P placed into the seclusion room 10 he or she will calm down, and can be returned to the main hospital population after a suitable time in the room. Sometimes it does happen that the patient becomes more and more violent after being placed into the seclusion room, and when the guard or attendant observes this, it becomes necessary to remove the patient from the room, so he or she can be administered medications so that the patient can return to normal behavior. However, as mentioned before it is often unsafe for an attendant, or team of attendants, to enter the room through the door 20 to bring the patient out during a period of violent behavior. Instead, in the seclusion room of this embodiment, the attendant or guard can bring the moving wall to its extended position, narrowing the patient space to a corridor of only about two by eight feet, and then allowing another attendant or guard, i.e, an extraction team member, to enter this narrow corridor from behind the moved wall 30, through the manway 68, and using the hatch 42 to push or urge the patient P towards the door 20, where he or she can be received safely, and blanketed, by other members of the extraction team. This occurs with minimum risk to patient or staff.

Figure 7:
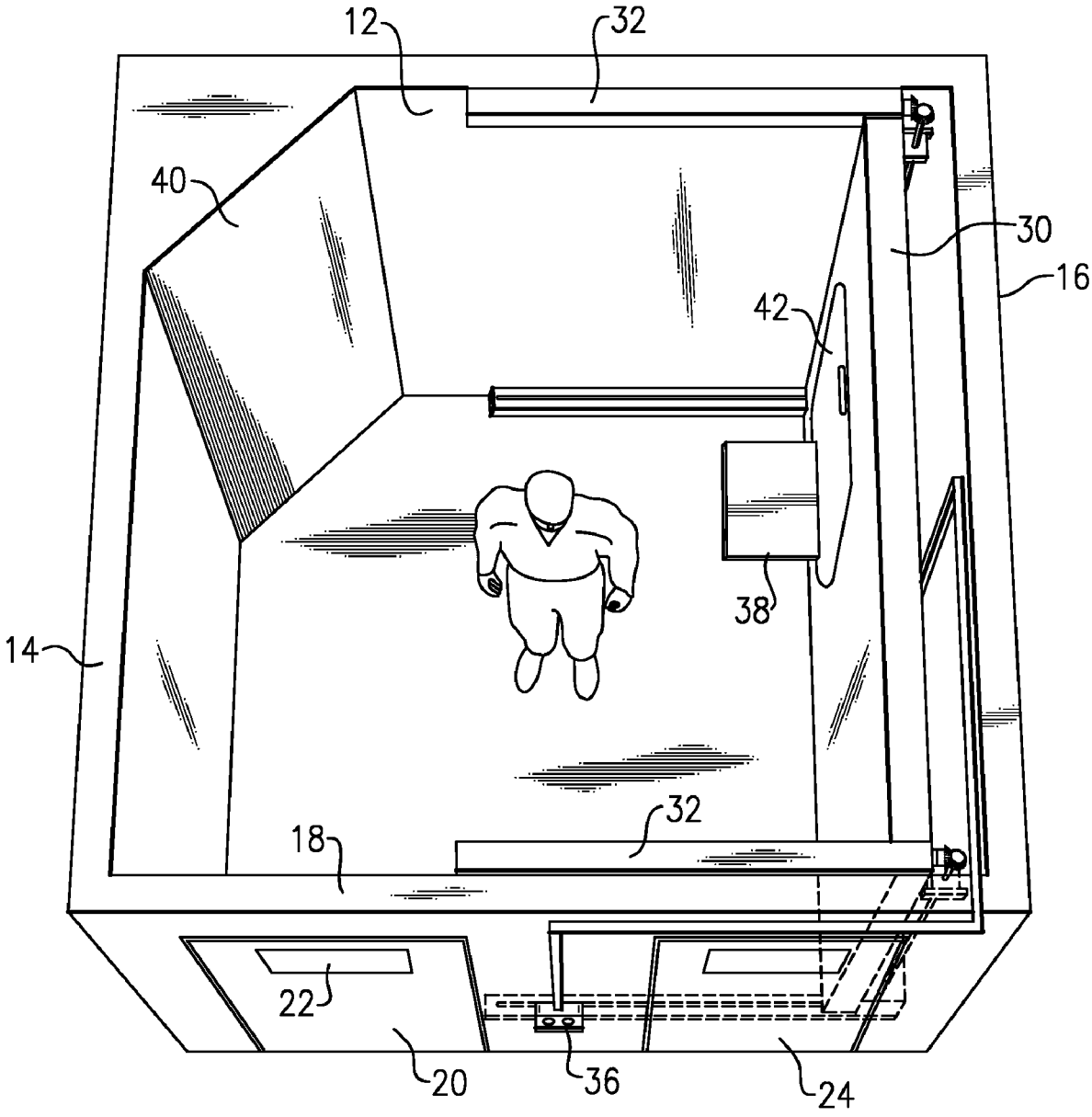
FIG. 7 is a top perspective view of the seclusion room of this embodiment.

As shown in FIG. 7, in normal circumstances, the moving wall 30 is positioned all the way to the right, i.e., against the second fixed side wall 16, and the patient is provided with the seat or bench 38. The attendant or guard can observe this patient through the observation window 22. If the attendant notices that the patient P is exhibiting signs of violent or uncooperative behavior, then the process can commence for limiting the patient's movement and removing the patient P from the seclusion room.

Figure 8:
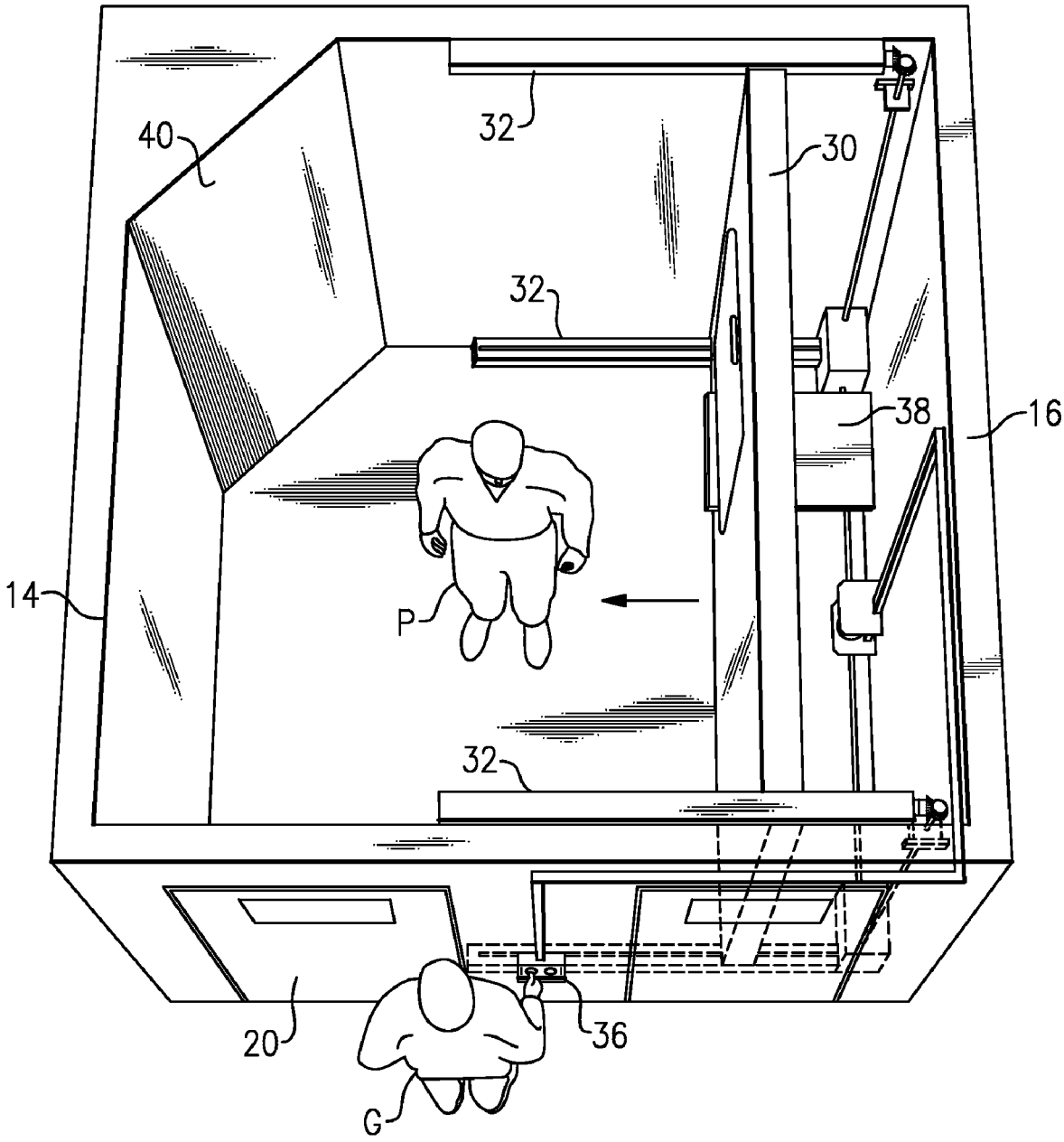
FIG. 8 is a top perspective view thereof with the wall commencing motion from the withdrawn position towards its extended position.
Figure 9:
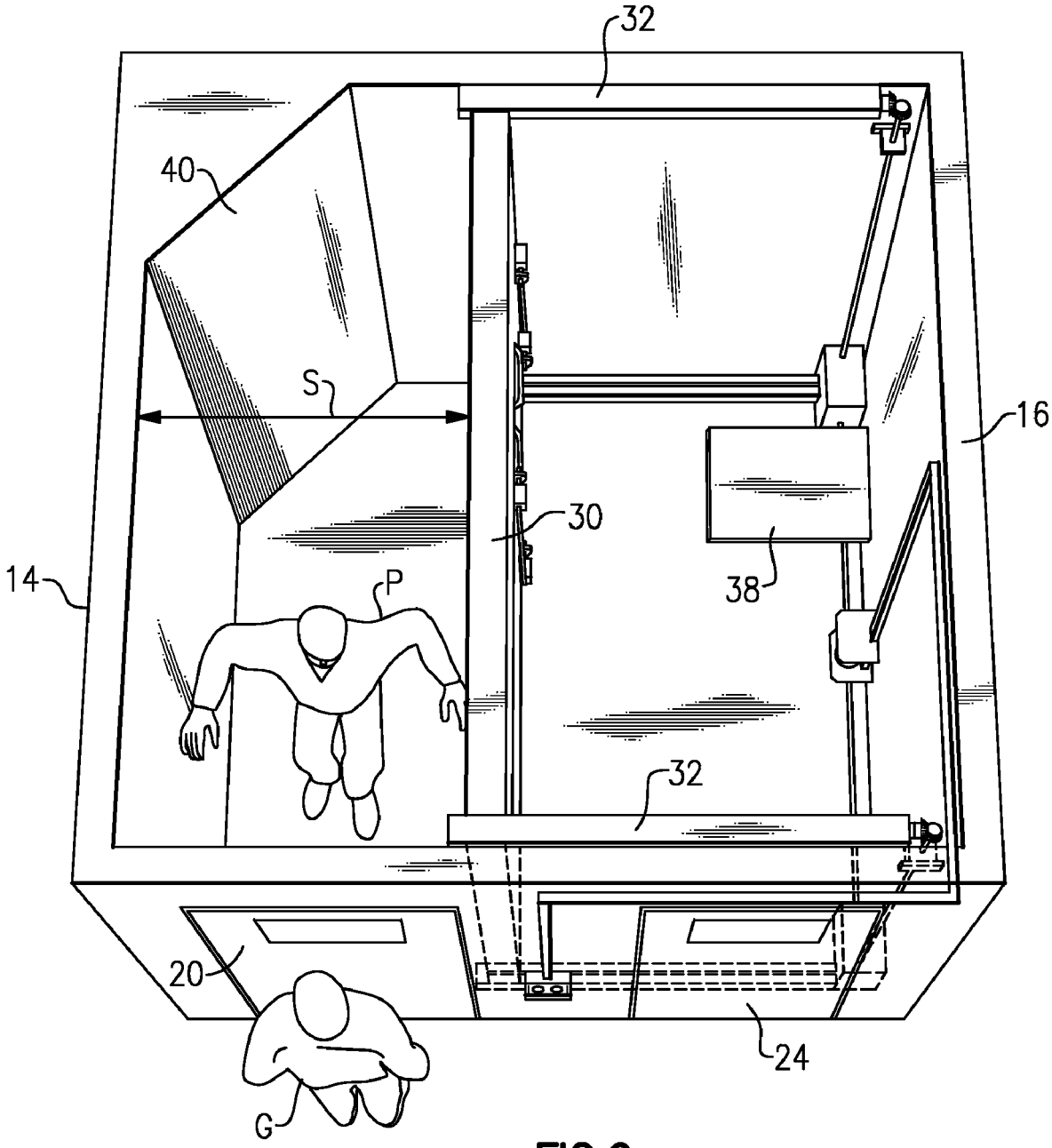
FIG. 9 is a top perspective view showing the moving wall at its extended position, and showing the patient confined to a narrowed space behind the primary door.
Figure 10:
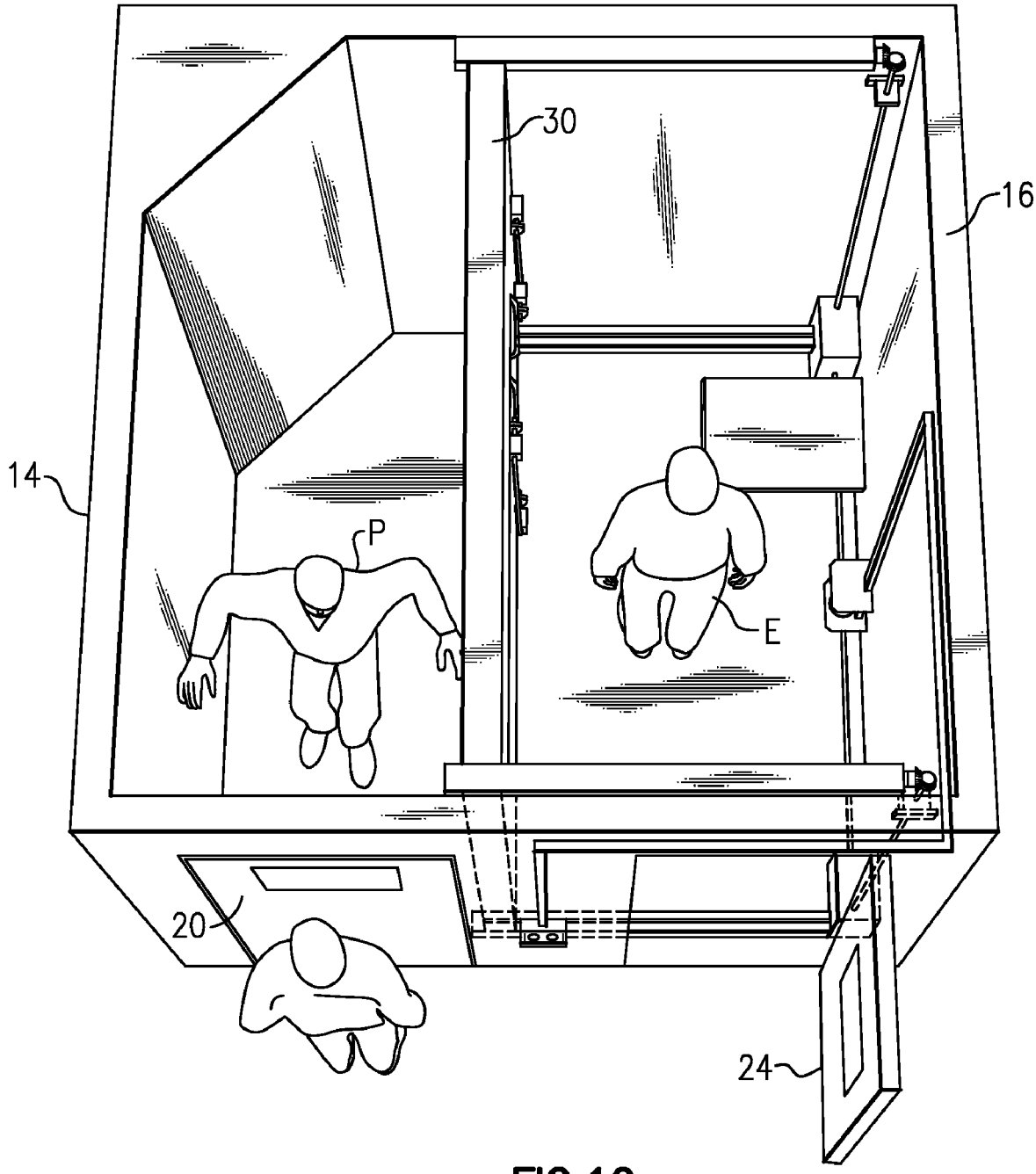
FIG. 10 is a top perspective view illustrating an extraction team member having entered the space behind the moving wall.
Figure 11:
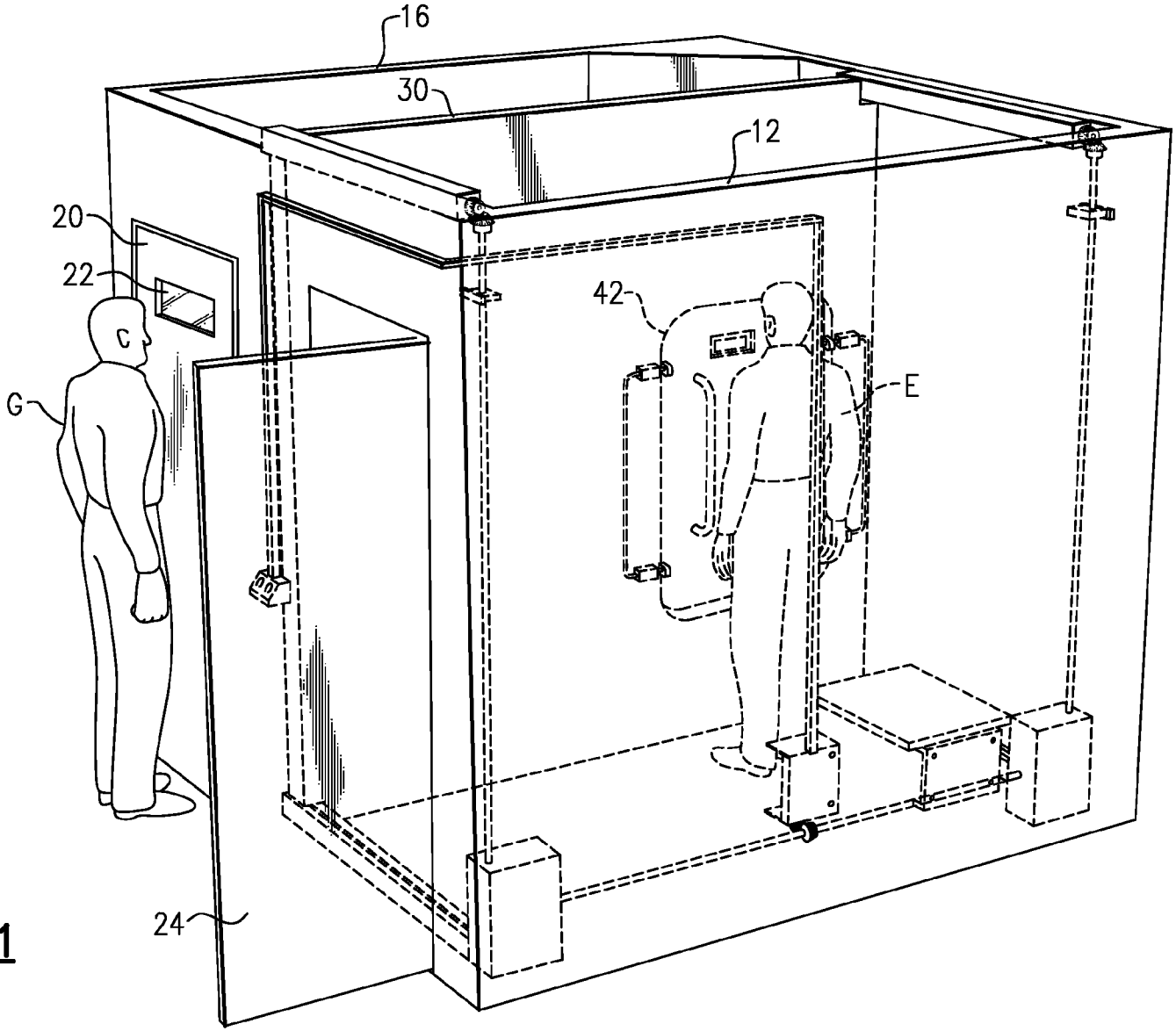
FIG. 11 is a perspective view thereof, partly in broken line, showing the extraction team member about to remove the hatch/shield from the manway provided in the moving wall.
Figure 12:
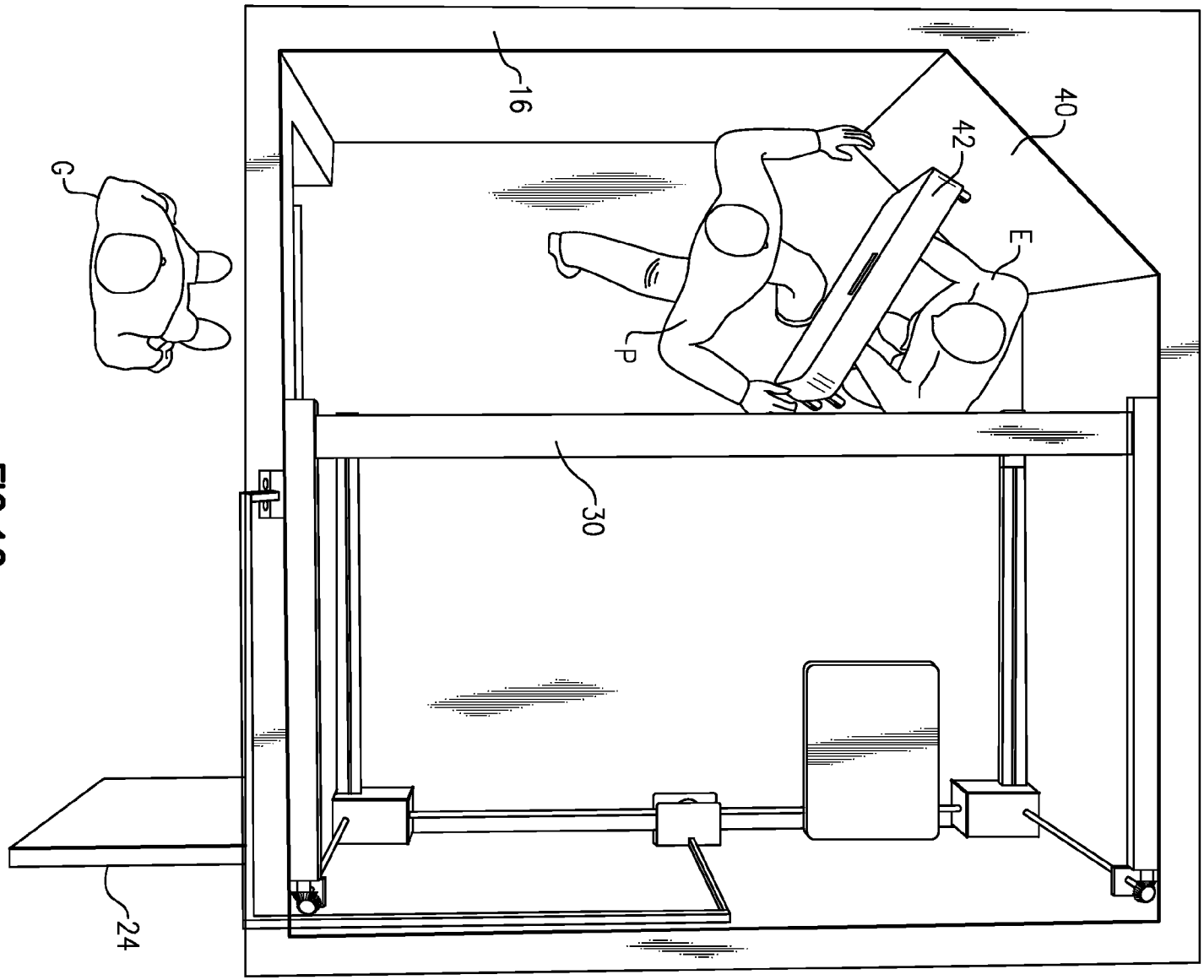
FIG. 12 is a top perspective view thereof showing the extraction team member urging the patient towards the main door of the seclusion room.
Figure 13:
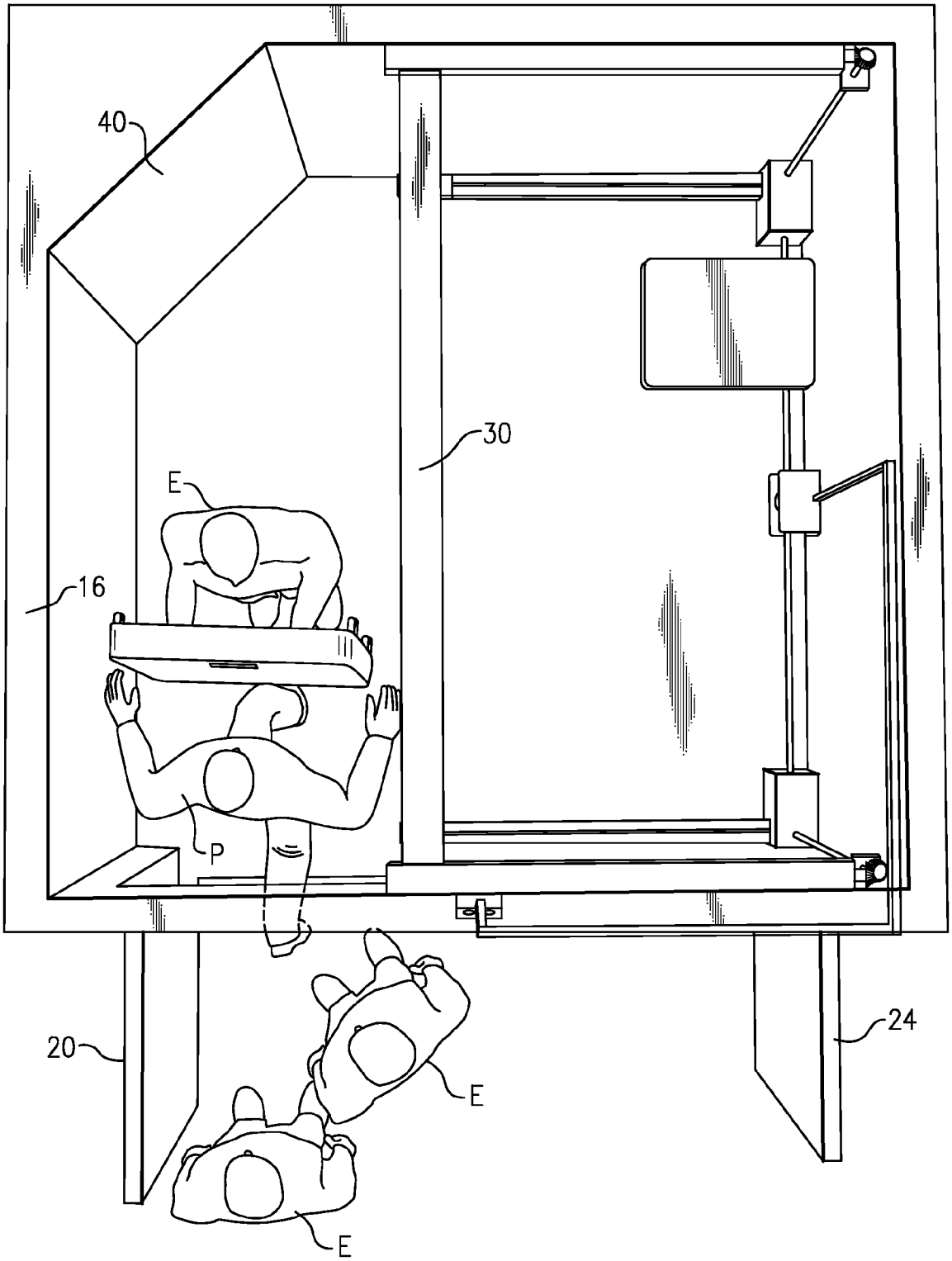
FIG. 13 is a top perspective view thereof showing other members of the extraction team receiving the patient being pushed or urged out the main door of the room.

As shown in FIG. 8, the attendant or guard G, who is stationed at the door 20, actuates one of the switches on the control panel 36, and this starts the wall 30 moving slowly to the left, i.e., towards the extended position and reducing the amount of patient space within the seclusion room. The seat 38 then disappears behind the moving wall 30. The wall 30 moves slowly across the room. It is often the case that the act of causing the wall to move will result in the patient beginning to act cooperatively, and ceasing his or her inappropriate behavior. If this does not occur, the guard G continues to move the wall 30 to the end of its travel. When the wall 30 has fully traversed the room, as shown in FIG. 9, there is only a narrow corridor space S remaining for the patient P. At this time, a second person, i.e., an extraction team member E, can open the second door 24 and enter the space behind the moving wall 30, as shown in FIG. 10. The team member E walks behind the wall 30 to the position of the hatch 42, as shown in FIG. 11. Team member E pulls the pins 70 to unlock the hatch 42, grabs the handles 74, and pushes the hatch 42 through the manway 68, and can use the hatch as a shield. The team member steps through the manway and enters the narrow corridor S or remaining patient space, behind the patient P, as shown in FIG. 12. Here, the angled wall 40 serves to block the patient from going around the hatch or shield 42. The extraction team member E then pushes the patient gently with the hatch shield 42, to force the patient towards the door 20. By slowly moving the shield down the narrow corridor, the extraction team member E safely moves the patient towards the exit door 20, where the guard or other team members can assist with safe removal, as shown in FIG. 13. The other members E of the extraction team can open the door 24 and receive the patient P.

The hatch 42 is easily reinstalled in the manway 68, and the pin locks 70 can be quickly reset. Then the wall 30 can be moved back to the withdrawn position again, so the room is ready for another patient.

Figure 14:
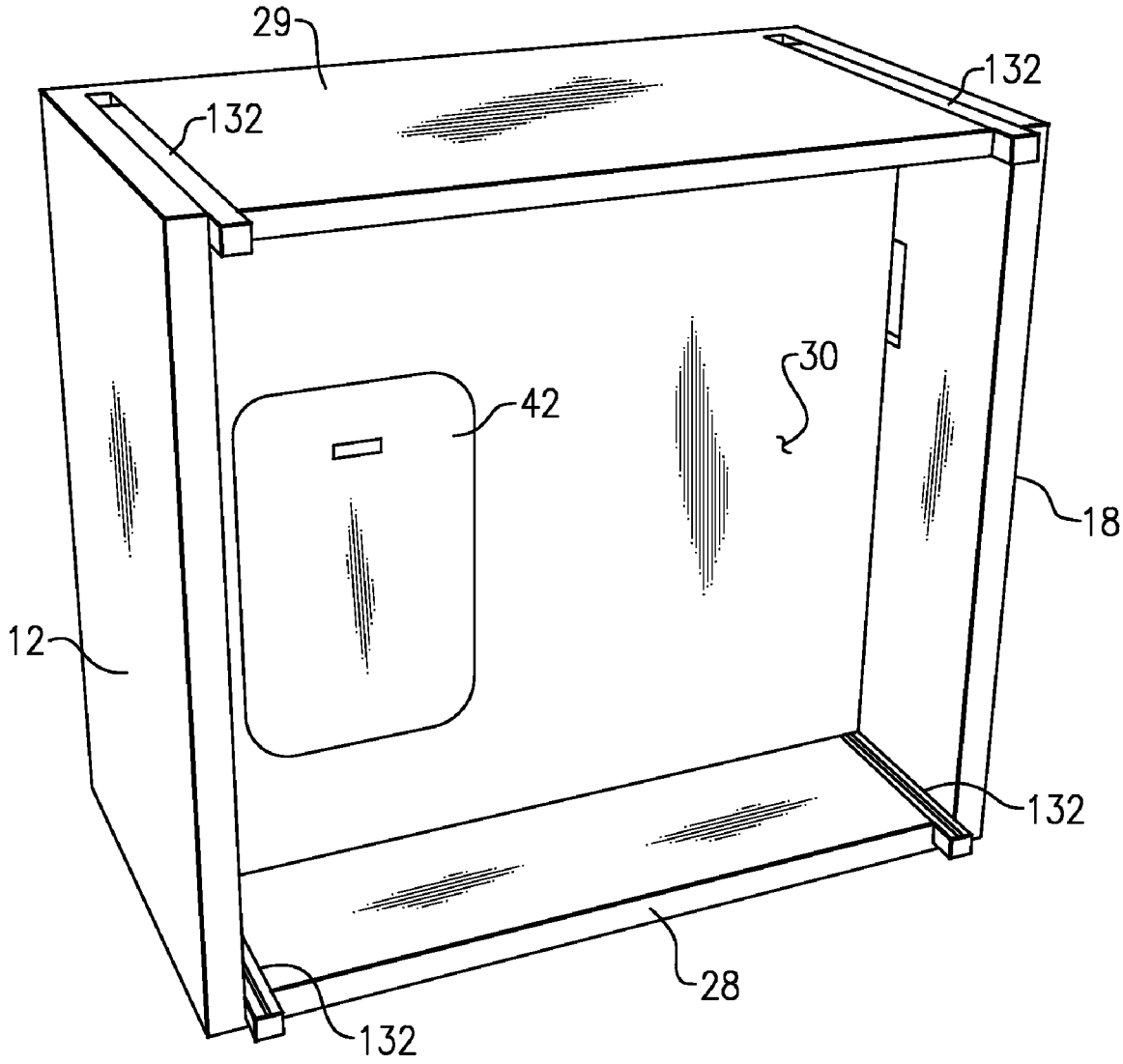
FIG. 14 is a cut-away perspective showing one alternative arrangement of the rail mechanism and moving wall of this invention.

FIG. 14 illustrates another possible embodiment, in which the guide rails or track members 132, similar in construction to the track members discussed earlier, are recessed in the floor 28 and in a ceiling 29 of the seclusion room, so that they are flush with the surfaces of the floor and ceiling at the corners where these surfaces meet the front wall 18 and back wall 12. In this version, the moving wall does not require the square cutouts at the corners that are present in the first embodiment, and the hardware that mates with the threaded drive rods in the track members 132 can be mounted onto the hidden edges of the moving wall 30.

In these embodiments, the edges of the moving wall 30 that meet the front wall, back wall, floor and ceiling can be provided with rubber flanges to keep the patient from inserting a finger or other body part into the spaces at the edges of the moving wall. Also, the slot provided in the track members 34 and 134 is kept narrow so that the patient cannot insert a finger or other body part, and will not injure himself or herself on the mechanism. The surfaces of the fixed walls and moving wall can be covered with a cushion material for self-injury prevention. Lighting can be provided from light fixtures positioned safely above the ceiling or behind one of the fixed walls, as need be.

The seclusion room that incorporates the main principles of this invention can be of other dimensions, and may incorporate additional features. An observation window may be provided in the second door 24 in some cases. Instead of an electric drive to move the wall 30, a manual system may be used, or a system powered by compressed air or another means.

While the invention has been described in detail with respect to a preferred embodiment, it should be recognized that there are many alternative embodiments that would become apparent to persons of skill in the art. Many modifications and variations are possible which would not depart from the scope and spirit of this invention.

We claim:

1. A patient seclusion enclosure comprising:

a floor, a ceiling, a back wall, a first fixed side wall, a second fixed side wall, and a front wall meeting said first and second fixed side walls at respective corners and having a first door disposed near the corner with said first wall and a second door near the corner with said second wall, said movable wall and said first fixed wall defining a patient seclusion space therebetween;

a movable side wall spanning from said floor to said ceiling and from said back wall to said front wall, and normally disposed in a withdrawn position against said second fixed wall;

track means disposed at said back wall and at said front wall engaging corresponding structure on said movable wall and extending from said second fixed wall to an position substantially at one edge of said first door, for permitting said movable wall to travel from said withdrawn position to an extended position near said edge of said first door;

said first wall and said movable wall defining a narrow space between them when the movable wall is in its extended position, said narrow space being aligned with said second door such that when said movable wall has been moved to its extended position, one or more members of an extraction team can enter the narrow space through said second door; and a hatch disposed in a manway in said movable wall at a side thereof towards said back wall and remote from said first door, said hatch being removable from said manway when said movable wall is in its extended position, such that said one or more members of the extraction team can enter the patient seclusion space from said narrow space through said hatchway, and can push a patient confined in said seclusion space out through said first door.

2. The patient seclusion room according to claim 1, wherein said hatch includes latch means actuable only from between the second wall and the movable wall to permit an extraction team member to remove said hatch to enter said narrow space, but deny removal of said hatch to the patient within said seclusion space.

3. The patient seclusion room according to claim 2, wherein said latch means includes a plurality of sliding pin locks, with pin members slidable mounted on said movable wall engaging respective pin apertures in said hatch.

4. The patient seclusion room according to claim 3, wherein said hatch is removable from said manway, said hatch includes one or more carrying handles on the side thereof remote from said seclusion space, and is adapted to be used as a shield by the extraction team member.

5. The patient seclusion room according to claim 4, wherein said one or more handles includes a pair of carrying handles disposed on a side thereof facing said second wall.

6. The patient seclusion room according to claim 4, wherein said hatch includes a visibility window formed of a transparent material, and adapted to permit said one or more members of the extraction team to be able to see the patient in the seclusion space through the visibility window in said hatch.

7. The patient seclusion room according to claim 1, comprising a patient seat, including a bracket member affixed onto said second wall, and a seat portion extending horizontally therefrom towards said first wall and cantilevered from said bracket member; and a slot in said movable wall through which said seat portion penetrates when the movable wall is in its withdrawn position.

8. The patient seclusion room according to claim 1, comprising a drive mechanism for controllably moving said movable wall between said withdrawn position and said extended position; including a motor, drive members within said track means which are rotatable in unison to move said movable wall, and rotary drive linkage means coupling said motor to said drive members.

9. The patient seclusion room according to claim 8, wherein said drive mechanism includes a control panel positioned on an exterior side of said front wall, with a manually actuable switch for commencing movement of said movable wall.

10. The patient seclusion room according to claim 1, further comprising an angled corner wall portion joining said back wall and said first side wall.

* * * * *